US007121644B2

(12) United States Patent
Ueda et al.

(10) Patent No.: US 7,121,644 B2
(45) Date of Patent: Oct. 17, 2006

(54) INK SUPPLY PORT SEALING CAP AND INKJET RECORDING APPARATUS

(75) Inventors: Kiyoshi Ueda, Anjo (JP); Yukio Shiohara, Nagoya (JP); Hiroaki Yazawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 292 days.

(21) Appl. No.: 10/874,393

(22) Filed: Jun. 24, 2004

(65) Prior Publication Data

US 2005/0018008 A1 Jan. 27, 2005

(30) Foreign Application Priority Data

Jun. 25, 2003 (JP) ..... 2003-181522

(51) Int. Cl.
*B41J 2/165* (2006.01)
*B41J 2/175* (2006.01)

(52) U.S. Cl. ..... 347/29; 347/86

(58) Field of Classification Search ..... 347/29–31, 347/9, 14, 49, 66, 85, 108; 206/204, 576
See application file for complete search history.

(56) References Cited

U.S. PATENT DOCUMENTS 6,827,417 B1 12/2004 Seino ..... 347/9

FOREIGN PATENT DOCUMENTS

| | | |
|---|---|---|
| JP | A-2002-79690 | 3/2002 |
| JP | A-2002-292904 | 10/2002 |
| JP | A-2003-54000 | 2/2003 |

*Primary Examiner*—Shih-wen Hsieh
(74) *Attorney, Agent, or Firm*—Oliff & Berridge, PLC

(57) ABSTRACT

An ink supply port sealing cap is to be used in an inkjet recording apparatus including a recording head unit having nozzles for ejecting ink, and first and second ink supply ports for supplying ink from first and second ink cartridges to the nozzles respectively. The ink supply port sealing cap includes: a first cap portion that seals the fist ink supply port; a second cap portion that seals the second ink supply port; and a coupling portion that separably couples the first and second cap portions.

21 Claims, 10 Drawing Sheets

INK SUPPLY PORT SEALING CAP AND INKJET RECORDING APPARATUS

BACKGROUND OF THE INVENTION

1. Field of the Invention

The present invention relates to an ink supply port sealing cap to be mounted on ink supply ports of inkjet recording apparatus in place of ink cartridges, and ink jet recording apparatus using the ink supply port sealing cap.

2. Description of the Related Art

Among printers, facsimile machines, and copying machines known in the background art, some utilize inkjet recording apparatus for ejecting ink droplets from nozzles of an inkjet head so as to form an image on a recording medium.

Of such apparatus, some is of a chip type in which a recording head is attached directly to a carriage movable forward and backward in a direction crossing the conveyance direction of a recording medium, while other is of a type in which a recording head unit is removably attached to a carriage. Apparatus of either type is often arranged so that ink cartridges are attached directly to a recording head.

In either type of apparatus configured thus, ink cartridges are attached to ink supply ports of a recording head so as to test the image forming operation or the image quality before the apparatus is shipped from a factory. Only ones passing the test are shipped as products. Among them, some products may be shipped in the condition that the recording head unit is filled with ink used for the test, while other products may be shipped in the condition that the recording head unit is filled with a special preservative solution after the ink used for test is eliminated.

In either case, however, when the tested apparatus is shipped in the condition that the ink supply ports are exposed, there is a fear that the ink or the preservative solution charged into the recording head unit leaks out due to the upside-down posture of the inkjet recording apparatus during transportation or storage, or the ink is evaporated during long-term storage, so that a user of the product will fail in forming an image later. Therefore, the ink supply ports are sealed with an ink supply port sealing cap having a flat-plate-like sealing portion or the like at the time of shipment (for example, see JP-A-2003-054000). Incidentally, the ink supply port sealing cap is described as a manifold cap in the document JP-A-2003-054000.

In such an ink supply port sealing cap, a cap portion corresponding to a black ink cartridge and a cap portion corresponding to a color ink cartridge are formed integrally. Accordingly, when the ink supply port sealing cap is mounted in a recording head unit on a manufacturing line, the cap portion corresponding to the black ink cartridge and the cap portion corresponding to the color ink cartridge can be mounted in one work. As a result, the working efficiency can be improved.

SUMMARY OF THE INVENTION

Generally in color-recordable, i.e. color-support inkjet recording apparatus, an actual recording operation cannot be executed unless both a black ink cartridge and a color ink cartridge are attached into a recording head unit. Therefore, after removing an ink supply port sealing cap from the inside of the recording head unit, a user has no choice but to attach the black ink cartridge and the color ink cartridge into the recording head unit actually.

Recently, there are increasing users who want to record only using black ink in such color-support inkjet recording apparatus. That is, there are increasing demands to use the inkjet recording apparatus as a monochrome facsimile machine or a monochrome printer.

However, in the inkjet recording apparatus in which an actual recording operation cannot be executed unless both a black ink cartridge and a color ink cartridge are attached into a recording head unit, a user wanting to perform only monochrome recording in black ink still has to attach the color ink cartridge into the recording head unit. On the contrary, a user wanting to perform only color recording in color inks also has to attach the black ink cartridge into the recording head unit. In such a case, when the black ink cartridge and the color ink cartridge are left attached to the recording head unit, a maintenance process becomes inevitable due to the characteristic of the inkjet recoding apparatus in order to prevent ink nozzles from being evaporated or clogged. As a result, not-in-use inks in the color ink cartridge will be consumed for the other purpose than recording though only the black ink cartridge is used, or not-in-use ink in the black ink cartridge will be consumed for the other purpose than recording though only the color ink cartridge is used. It is wasteful for a user wanting to perform only monochrome recording in black ink or a user wanting to perform only color recording in color inks because of necessity of purchasing the other (not-in-use) ink cartridge.

Therefore, there has been proposed a technique for using inkjet recording apparatus with only one of a black ink cartridge and a color ink cartridge while a dummy cartridge is attached in place of the other ink cartridge. However, an integral-type ink supply port sealing cap as in the background art cannot be used as the dummy ink cartridge. It is therefore necessary for the user to prepare the dummy cartridge separately. Thus, there is a problem that it is troublesome to operate the dummy cartridge and it is very inconvenient to handle the dummy cartridge.

The invention was developed to solve the foregoing problems, and one of objects thereof is to provide an ink supply port sealing cap by which a user wanting to use only black ink can perform recording without purchasing and attaching a real color ink cartridge, and a user wanting to use only color inks can perform recording without purchasing and attaching a real black ink cartridge, while operation can be achieved efficiently for testing on a manufacturing line in a factory, and the ink supply port sealing cap can be handled simply and stored easily, and to provide inkjet recording apparatus using the ink supply port sealing cap.

In order to achieve the above object, according to a first aspect of the invention, there is provided an ink supply port sealing cap to be used in an inkjet recording apparatus including a recording head unit having nozzles for ejecting ink, and first and second ink supply ports for supplying ink from first and second ink cartridges to the nozzles respectively, the ink supply port sealing cap including: a first cap portion that seals the fist ink supply port; a second cap portion that seals the second ink supply port; and a coupling portion that separably couples the first and second cap portions.

According to a second aspect of the invention, there is provided an inkjet recording apparatus including: a recording head unit having nozzles for ejecting ink; a mounting portion on which first and second ink cartridges are mounted, and on which first and second cap portions of an ink supply port sealing cap are to be mounted in place of the first and second ink cartridges respectively, the ink supply port sealing cap including a coupling portion that separably couples the first and second cap portions; first and second ink supply ports that supply ink from the first and second ink cartridges to the nozzles respectively, the first and second ink supply ports are sealed by the first and second cap portions respectively; and a control unit that controls the recording head unit to perform a recording operation, and performs the recording operation in a condition where either one of the first and second ink cartridges is mounted on the mounting portion and either one of the first and second cap portions is mounted on the mounting portion in place of the other of the first and second ink cartridges.

BRIEF DESCRIPTION OF THE DRAWINGS

A preferred embodiment of the present invention will be described in detail with reference to the following accompanying drawings, in which.

DETAILED DESCRIPTION OF THE PREFERRED EMBODIMENTS

Referring now to the accompanying drawings, a description will be given in detail of preferred embodiments of the invention.

Figure 1:
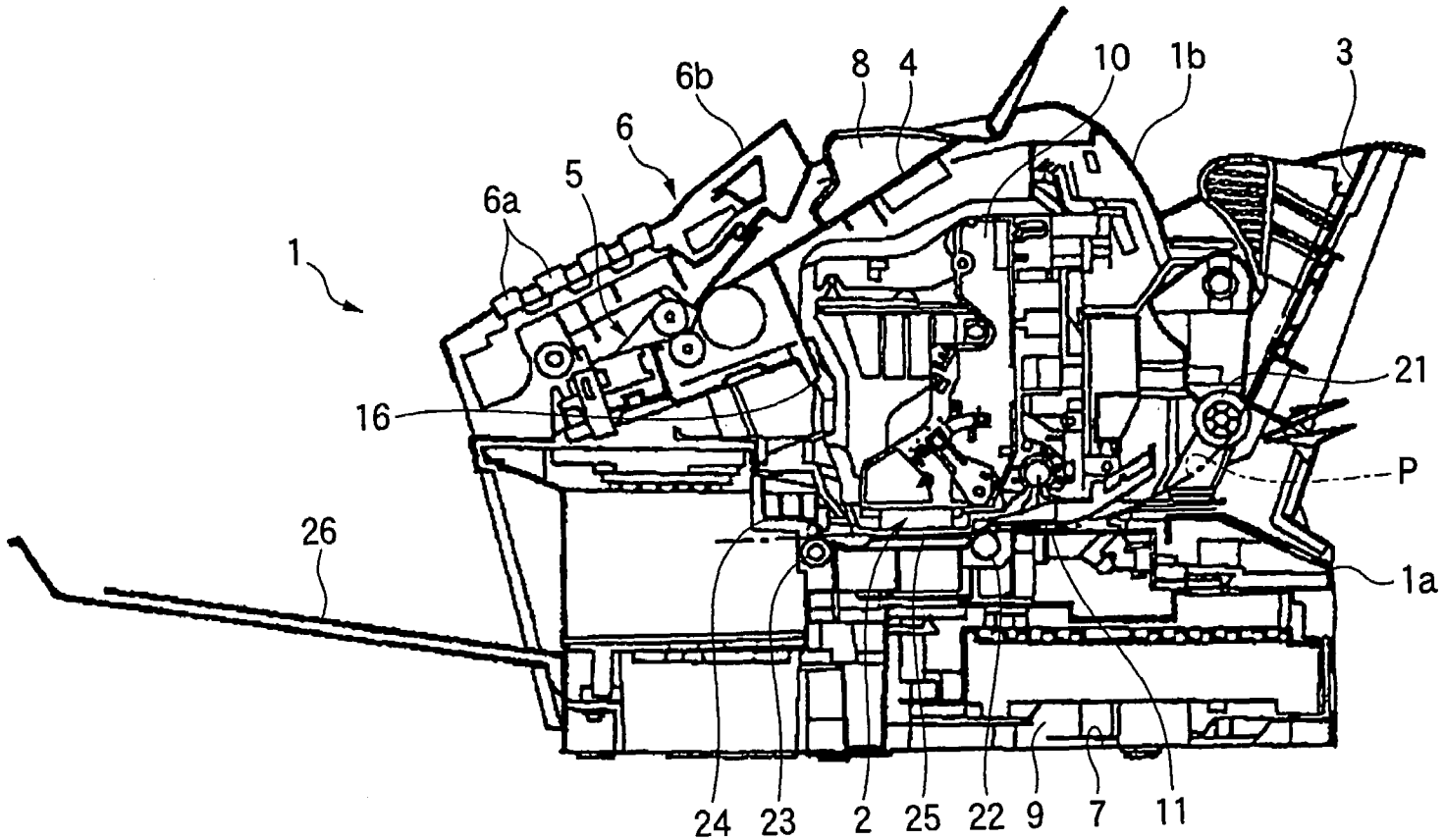
FIG. 1 is a schematic side view of an inkjet recording apparatus according to an embodiment of the invention.

FIG. 1 is a schematic right side view of inkjet recording apparatus having a printer function and a facsimile function.

In FIG. 1, a body casing of inkjet recording apparatus 1 has a main lower casing 1*a* made from synthetic resin and an upper casing 1*b* made from synthetic resin. The main lower casing 1*a* receives an inkjet recording portion 2 and includes a sheet feeding tray 3 tilting upward on the rear side (right side in FIG. 1). The sheet feeding tray 3 is provided for supplying sheet P for forming an image thereon. The upper casing 1*b* covers the top of the main lower casing 1*a*.

A document mounting portion 4 is disposed in a portion close to the rear top of the upper casing 1*b*. The document mounting portion 4 is designed to be able to rotate with respect to the upper casing 1*b*. Exchange of inks or the like is performed through the document mounting portion 4. A document reading unit 5 as a document reading portion is attached to a portion close to the front of the document mounting portion 4. The upper side of the document reading unit 5 is covered with an operation panel 6.

An operation key portion 6*a* including various function keys and a ten key pad, and a display portion 6*b* such as a liquid crystal panel capable of displaying values inputted from the operation key portion 6*a* or characters for various commands are provided in the surface of the operation panel 6. A pair of left and right document guide pieces 8 and 8 for guiding the opposite, left and right side edges of a document to be conveyed are attached to the document mounting portion 4 movably to left and right synchronously.

Incidentally, the lower surface of the main lower casing 1*a* is closed with a bottom cover plate 7 made from a metal plate or the like. A control unit 9 is disposed in an internal space of the main lower casing 1*a*. The control unit 9 controls the recording head to perform a recording operation. Though not shown, the control unit 9 includes a control board, a power supply board, an NCU (Network Control Unit) board for opening the way for conversation with other telephone sets or transmission/reception of facsimile data with other facsimile machines through a phone line.

The lower portion rear end of the carriage 10 in the recording portion 2 is mounted on a round-shaft-like guide shaft 11 slidably and rotatably. The guide shaft 11 is laid on the surface side of the lower portion of an upright frame 12 (see FIG. 2) which is longer in the left/right direction.

A not-shown timing belt is provided in parallel with the guide shaft 11. The timing belt is wound on a not-shown driven pulley and a driving pulley (not shown). The driven pulley is disposed closely to one side of the frame 12, and the driving pulley is fixed to the output shaft of a drive motor (not shown) such as a stepping motor which can rotate forward and backward. The timing belt is coupled at one place with the carriage 10 so that the carriage 10 can move forward and backward in parallel with the guide shaft 11. Incidentally, sheets of the sheet P stacked on the sheet feeding tray 3 are separated one by one by a sheet feeding roller 21 and a separation unit. The sheet feeding roller 21 serves as a sheet feeding mechanism with a structure known well conventionally and is disposed in the rear portion of the main lower casing 1*a*. The separation unit is constituted by a separation pad, a frictional separation plate or the like. The front end position of the separated sheet P is once adjusted by a registration roller 22. After that, the sheet P is fed between the bottom of the recording head unit 15 and a platen 25. While the sheet P is held and conveyed between a pair of upper and lower conveyance rollers 23 and 24 on the downstream side of conveyance, ink droplets are ejected onto the upper surface of the sheet P in accordance with an image formation instruction so as to form an image thereon. After that, the sheet P is discharged to a delivery tray 26.

Figure 2:
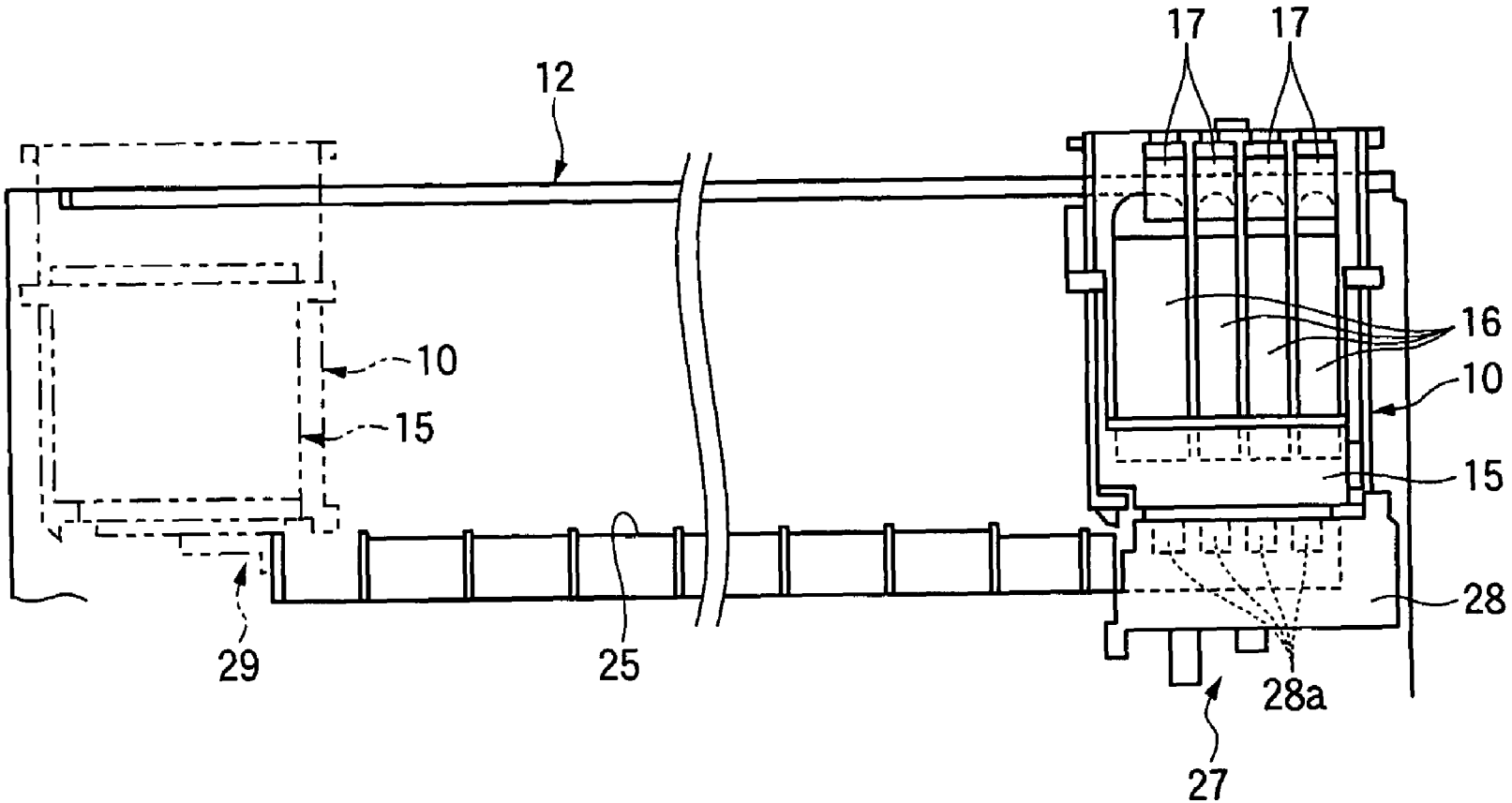
FIG. 2 is a schematic front view showing the left/right-direction moving state of a carriage with respect to a frame.

In addition, a maintenance portion 27 is provided out of the recording area and near the moving end of the carriage 10, for example, on the right side of the platen 25 as shown in FIG. 2. A nozzle wiping unit for wiping ink droplets adhering to the surfaces of nozzle portions 15*a* (see FIG. 3A) of the recording head unit 15, and a purging unit (nozzle suction unit) 28 for recovering the recording head unit 15 from non-ejection of ink or failure in ejection of ink are disposed in the maintenance portion 27. In the purging unit 28 (nozzle suction unit), the nozzle portions 15*a* of the recording head unit 15 are covered with suction caps 28*a*, and defective ink in the recording head unit 15 is sucked due to negative pressure generated by a suction pump driven by a not-shown line feed motor so that the recording head unit 15 is recovered from failure in recording.

Incidentally, in FIG. 2, a flushing portion 29 for ejecting ink from each nozzle portion 15*a* of the recording head unit 15 tentatively so as to prevent ink clogging is provided in the left end of the platen 25.

On the other hand, in a close-to-top portion of the inner surface of the back plate of the carriage 10, a detection sensor such as a limit switch is provided for detecting whether each regular ink cartridge 16 or each ink supply port sealing cap 51 which will be described later is attached to the carriage 10 and hence an ink cartridge receiving portion of the recording head unit 15 or not. Each pressure lever 17 serving as a fixing device is provided to be able to rotate upward/downward on the upper end side of the carriage 10. As soon as the lever 17 presses the regular ink cartridge 16 or the ink supply port sealing cap 51 so as to bring the ink cartridge 16 or the ink supply port sealing cap 51 into a lock state where the lock surface is in engagement with the lock portion, a rotatable detection lever is pressed by the base end portion of the pressure lever 17 so as to push a sensitive portion of a first sensor and thereby output a predetermined signal.

However, when the free end side of the pressure lever 17 turns upward to be not locked, it is concluded that the ink cartridge 16 or the ink supply port sealing cap 51 is absent. Then, an OFF signal is outputted.

Next, description will be made on the configuration of the recording portion 2. The color inkjet cartridge type recording head unit 15 shown in FIG. 3A faces downward and is removably attached to the carriage 10. The recording head unit 15 for performing color recording includes four nozzle portions 15*a* on its bottom side. The nozzle portions 15*a* are provided for ejecting inks of colors of black, yellow, magenta and cyan respectively. Ink cartridges 16 for the respective colors can be removably mounted on the top side of the recording head unit 15. Ink to be supplied to the recording head unit 15 has been received in each ink cartridge 16. The ink cartridges 16 can be pressed downward and fixed with their bottoms up respectively by the pressure levers 17 which can rotate upward and downward on the upper end side of the carriage 10.

Figure 3A:
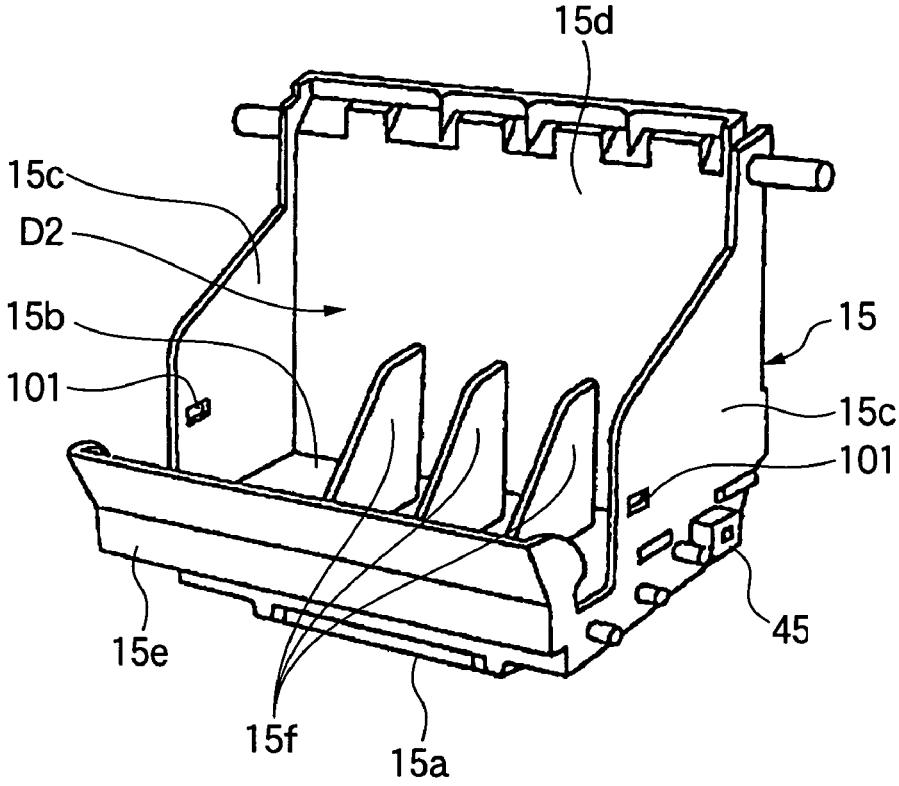
FIG. 3A is a perspective view of a recording head unit.

In the recording head unit 15, as shown in FIG. 3A, the nozzle portions 15*a* are provided on the lower surface side of a bottom plate 15*b*, and an inner space surrounded by the bottom plate 15*b*, opposite, left and right side plates 15*c* and 15*c*, a back plate 15*d*, and a short front plate 15*e* serves as an ink cartridge receiving portion D2 for receiving the ink cartridges 16.

Figure 3B:
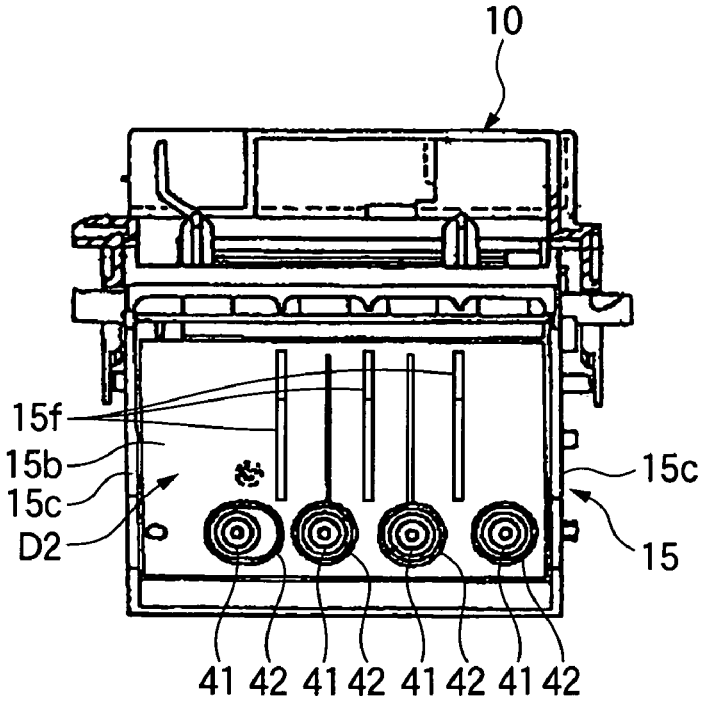
FIG. 3B is a top view of the recording head unit.

In the ink cartridge receiving portion D2, as shown in FIG. 3B, four ink supply ports 41 corresponding to not-shown ink ejecting ports provided in the lower surfaces of the ink cartridges 16 for the four colors of black, yellow, magenta and cyan are opened upward on the upper surface of the bottom plate 15*b*. In addition, elastic rings 42 (seal members) for preventing ink leakage are attached to the ink supply ports 41 respectively. The four ink supply ports 41 are made to communicate with manifolds for reserving inks for the colors respectively.

Further, partition plates 15*f* are provided erectly in the ink cartridge receiving portion D2 so that the ink cartridges 16 for the respective colors can be partitioned and disposed.

With reference to FIGS. 4 and 5A–5D, description will be made on the configuration of the ink supply port sealing cap 51 for covering the top of the recording head unit 15 in place of the ink cartridges 16 so as to seal up the ink supply ports 41 communicating with the manifolds.

Figure 4:
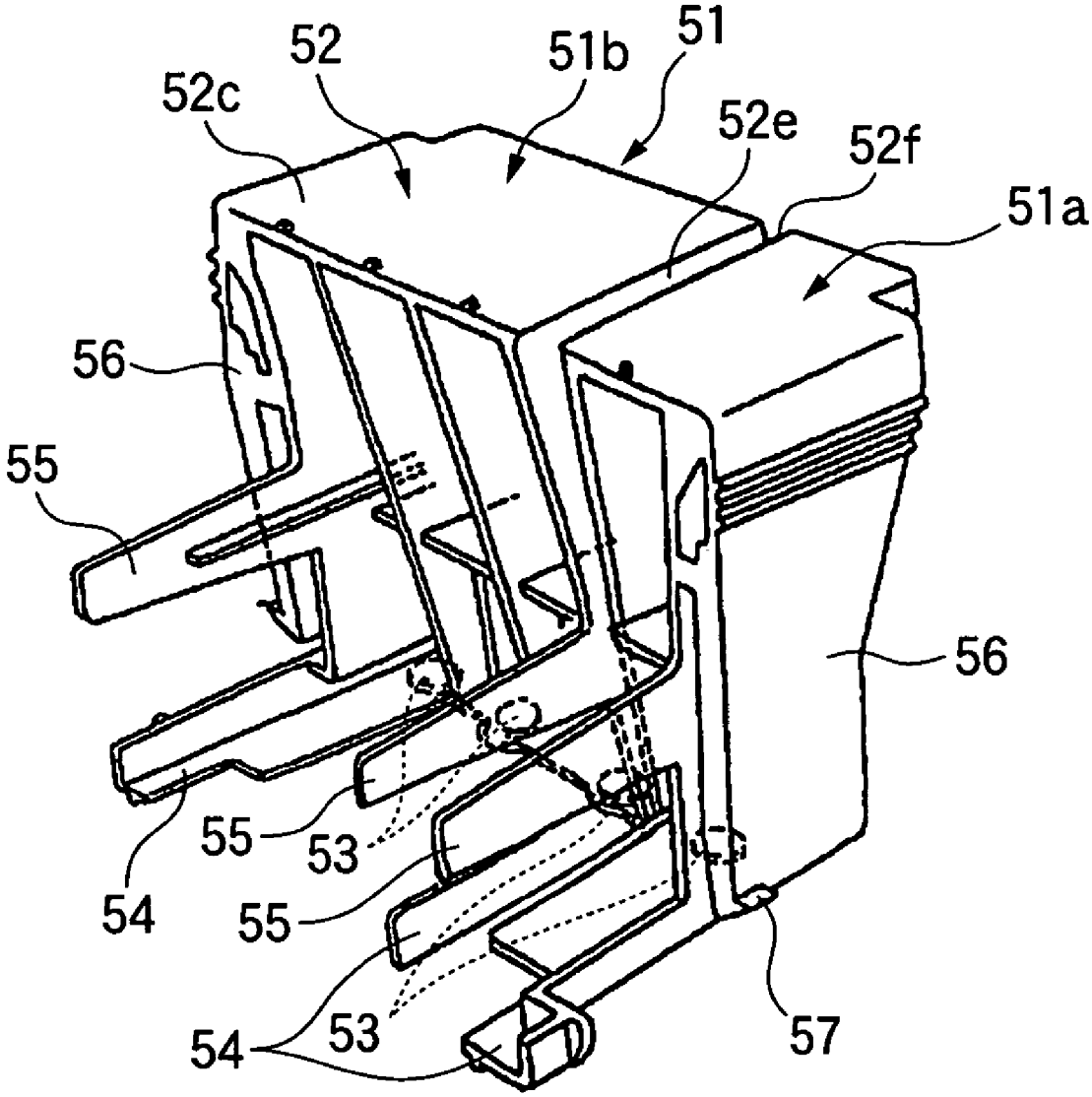
FIG. 4 is a perspective view of an ink supply port sealing cap.
Figure 5A:
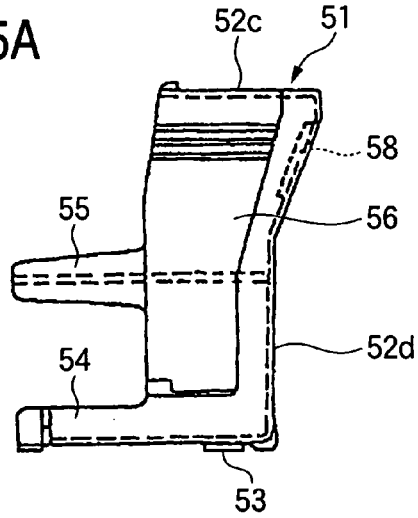
FIG. 5A is a side view of the ink supply port sealing cap.
Figure 5B:
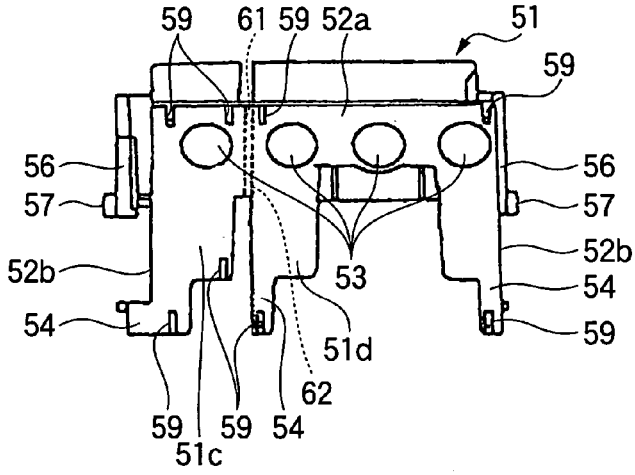
FIG. 5B is a bottom view of the ink supply port sealing cap.
Figure 5C:
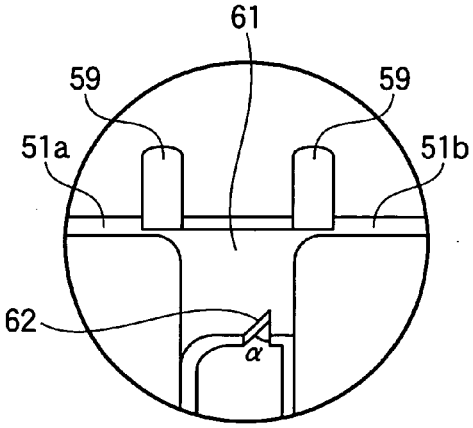
FIG. 5C is a partially enlarged view of a coupling portion.
Figure 5D:
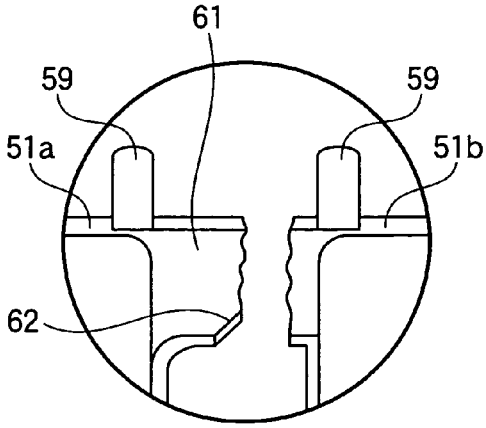
FIG. 5D is a partially enlarged view of the coupling portion cracked along a notch portion.

Incidentally, FIG. 4 is a perspective view of the ink supply port sealing cap. FIG. 5A is a side view of the ink supply port sealing cap. FIG. 5B is a bottom view of the ink supply port sealing cap. FIG. 5C is a partially enlarged view of a coupling portion 61 depicted in FIG. 5B, where the bottom view of the ink supply port sealing cap in FIG. 5B is observed from its bottom. FIG. 5D is a partially enlarged view of the coupling portion 61 divided along a notch portion 62.

The ink supply port sealing cap 51 is constituted by a first cap portion 51*a* and a second cap portion 51*b*. The ink supply port sealing cap 51 is a semitransparent molding made from synthetic resin such as polypropylene. The ink supply port sealing cap 51 is, for example, milky-white. The ink supply port sealing cap 51 can seal the four ink supply ports 41 all at once correspondingly to the color printing (four-color) recording head unit 15.

That is, the ink supply port sealing cap 51 is constituted by a backward-faced box 52 open to the back plate of the recording head unit 15. Substantially disc-like sealing portions 53 corresponding to the four ink supply ports 41 are formed to project on the lower surface of a lower plate 52*a* (FIG. 5B) of the box 52.

In addition, a pair of left and right foot pieces 54 project backward from the lower plate 52*a* and opposite, left and right plates 52*b* and 52*b* of the box 52, and a pair of left and right arms 55 project backward from the vertically middle portions of the lower plate 52*a* and the opposite, left and right plates 52*b* and 52*b* of the box 52. When the ink supply port sealing cap 51 is attached to the recording head unit 15, the front ends of the foot pieces 54 and the arms 55 abut against the back plate 15*d* of the recording head unit 15 so as to be positioned without tilting.

Figure 6:
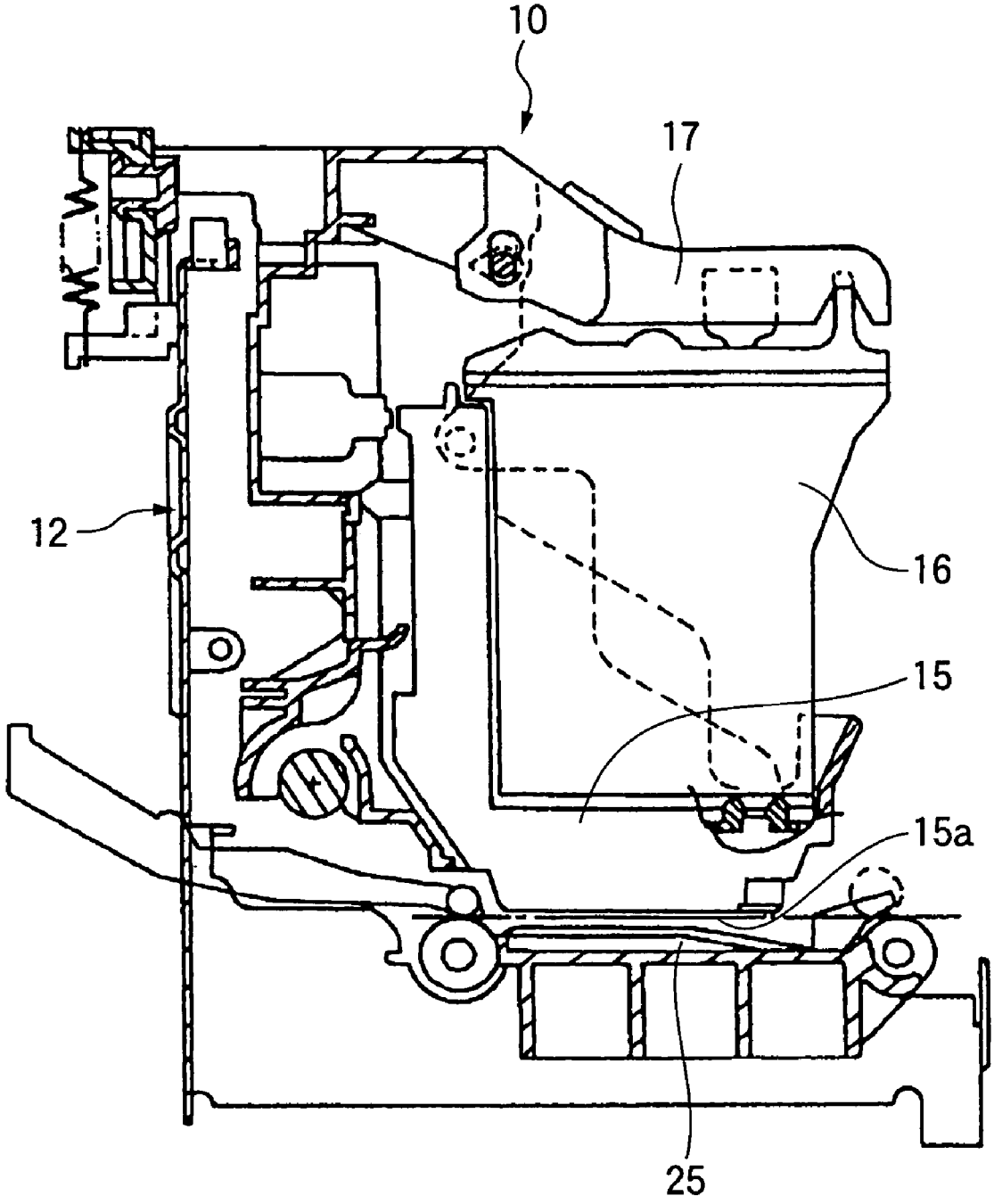
FIG. 6 is a side view of the carriage where an ink cartridge is mounted on a mounting portion.
Figure 7:
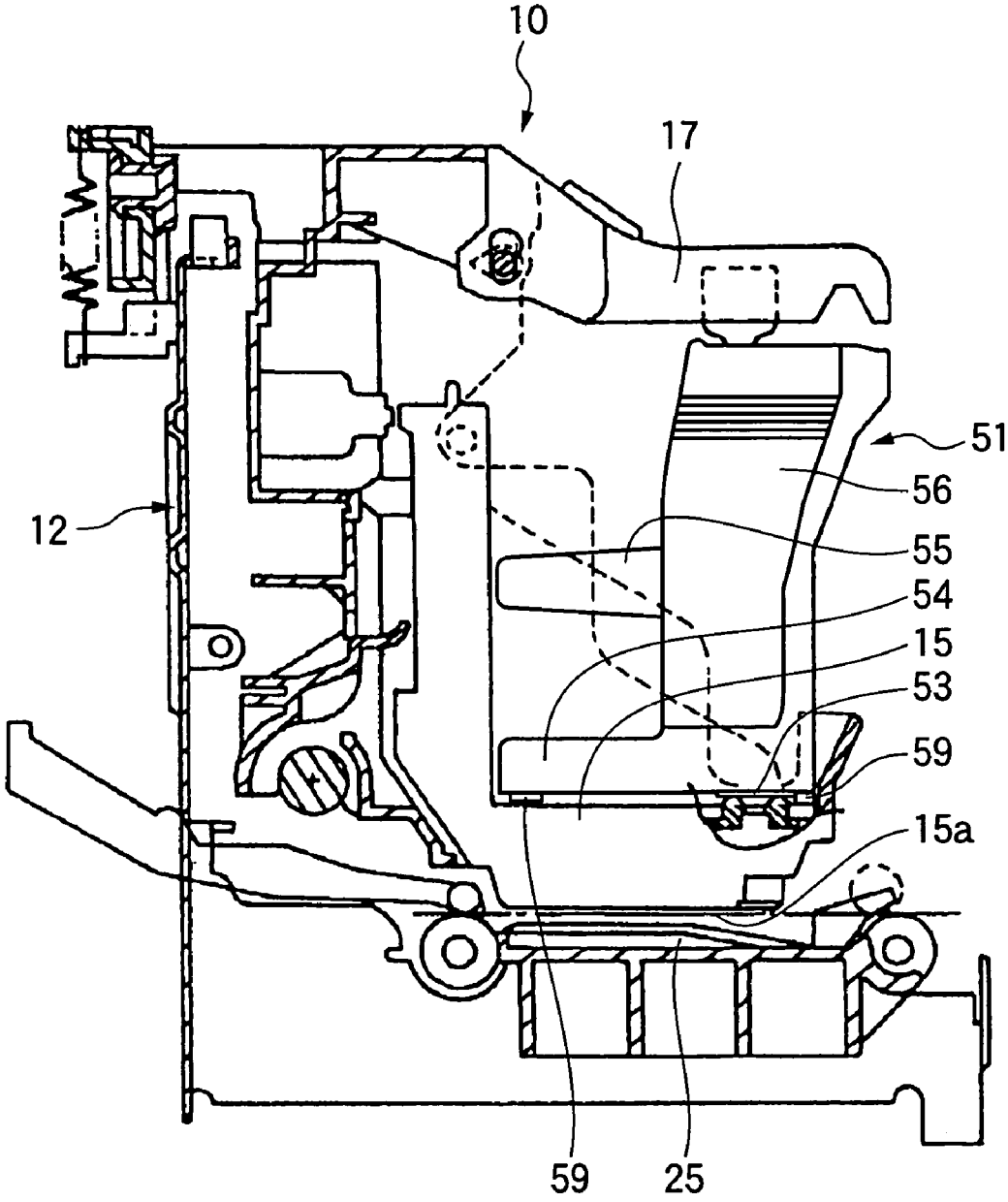
FIG. 7 is a side view of the carriage where the ink supply port sealing cap is mounted on the mounting portion.

An example of a state where the ink cartridges 16 are mounted on the mounting portion 4 is shown in FIG. 6, and an example of a state where the ink supply port sealing cap 51 is mounted on the mounting portion 4 is shown in FIG. 7.

The inkjet recording apparatus 1 according to this embodiment is typically designed to perform recording with the four ink cartridges 16 of a black ink and color inks (yellow, magenta and cyan). Some users may want to record using only the black ink, while other users may want to record using only the color inks. Therefore, the inkjet recording apparatus is designed as follow. For a user who wants to record using only the black ink, a regular black ink cartridge and the second cap portion 51*b* are attached to the ink cartridge receiving portion D2 of the recording head unit 15 so that the inkjet recording apparatus 1 can record using the black ink. For a user who wants to record using only the color inks, three regular color ink cartridges and the first cap portion 51*a* are attached to the ink cartridge receiving portion D2 of the recording head unit 15 so that the inkjet recording apparatus 1 can record using the color inks. However, in fact, when the number of users wanting to record using only black ink is compared with the number of users wanting to record using only color inks, the former is larger than the latter. That is, since it is decided that the number of users using the regular black ink cartridge and the second cap portion 51*b* is larger, the arms 55 are provided not only in the opposite, left and right side plates 52*b* but also in the other side plate 52*e* of the second cap portion 51*b*. Due to the two arms 55 belonging to the second cap portion 51*b*, the front ends of the two arms 55 of the second cap portion 51*b* abut against the back plate 15*d* of the recording head unit 15 even when only the second cap portion 51*b* is attached to the ink cartridge receiving portion D2. As a result, the second cap portion 51*b* is stabilized in the same manner as the ink supply port sealing cap 51 is attached to the recording head unit 15. Thus, the second cap portion 51*b* can be positioned without falling.

However, it is not possible to deny the existence of users wanting to record using only color inks. Therefore, though not shown, the arms 55 may be provided also in the other side plate 52*f* of the first cap portion 51*a*. With such a configuration, even when only the first cap portion 51*a* is attached to the ink cartridge receiving portion D2, the front ends of the two arms 55 of the first cap portion 51*a* abut against the back plate 15*d* of the recording head unit 15 so that the first cap portion 51*a* is stabilized in the same manner as the ink supply port sealing cap 51 is attached to the recording head unit 15. Thus, the first cap portion 51*a* can be positioned without falling.

Elastic pieces 56 and 56 extending downward from a top plate 52*c* of the box 52 are provided outside the opposite, left and right side plates 52*b* and 52*b*. Engagement claws 57 and 57 are provided in the lower ends of the elastic pieces 56 and 56 respectively so as to elastically engage with lock holes 101 (see FIG. 3A) provided in the opposite, left and right sides 15*c* and 15*c* of the recording head unit 15. A light reflecting portion 58 like a prism longer than is wide is formed integrally with the inner surface of a front plate 52*d* of the box 52. The top plate 52*c* of the box 52 is a place where a pressure block in the pressure lever 17 abuts.

In addition, protrusions 59 serving as regulation members are formed in the four corners of a lower surface 51*c* of the first cap portion 51*a* of the ink supply port sealing cap 51 and the four corners of a lower surface 51*d* of the second cap portion 51*b* respectively. Thus, four protrusions 59 are formed in the lower surface 51*c*, 51*d* of each cap portion 51*a*, 51*b*.

When the ink supply port sealing cap 51 is pressed downward by the pressure lever 17, the sealing portions 53 of the cap portions 51*a* and 51*b* may be excessively pressed onto the elastic rings 42 (sealing members) sealing the ink supply ports 41 of the recording head unit 15 so that the elastic rings 42 (seal members) are deformed to lose its sealing effect. In order to prevent this, the protrusions 59 abut against the bottom plate 15*b* of the ink cartridge receiving portion D2 so as to regulate the distance between each ink supply port 41 and each sealing portion 53.

In addition, a total of four protrusions 59 are formed in each of the first and second cap portions 51*a* and 51*b* so that each of the four corners of each lower surface 51*c*, 51*d* of the first and second cap portions 51*a* and 51*b* has one protrusion 59. Accordingly, when each cap portion 51*a*, 51*b* is used separately and individually, the protrusions 59 surely abut against the bottom plate 15*b* of the ink cartridge receiving portion D2 so that the distance between each ink supply port 41 and each sealing portion 53 can be regulated.

A coupling portion 61 is formed integrally with the lower plate 52*a* of the box 52 of the ink supply port sealing cap 51 on the ink supply port 41 side of the ink supply port sealing cap 51 (on the nozzle portion 15*a* side of the recording head unit 15). The coupling portion 61 couples the first cap portion 51*a* and the second cap portion 51*b* with each other. The coupling portion 61 is made from the same material polypropylene as the ink supply port sealing cap 51. In the coupling portion 61, a notch portion 62 which is thin as a whole is formed in the inner surface which is one of the surfaces of the coupling portion 61. When a force is applied to the coupling portion 61, the coupling portion 61 is cracked easily along the notch portion 62 so as to separate the first cap portion 51*a* and the second cap portion 51*b* from each other.

In this case, since the notch portion 62 is formed in the coupling portion 61 at a predetermined angle α, for example, 45 degrees, an external force acts on the notch portion 62 effectively so that the coupling portion 61 can be cracked easily.

In this event, since the notch portion 62 is formed near the second cap portion 51*b* and cut toward the first cap portion 51*a* at an angle of 45 degrees, the coupling portion 61 is cracked due to an external force applied thereto so that most of coupling portion pieces survive on the first cap portion 51*a* side as shown in FIG. 5D. Accordingly, when black printing is performed in the state where a black ink cartridge is attached in place of the first cap portion 51*a* and the second cap portion 51*b* is attached in the portion where the color ink cartridges should be mounted, there is no fear that the coupling portion pieces generated when the coupling portion 61 is cracked project from the second cap portion 51*b*. Thus, the black ink cartridge can be mounted without being disturbed by the coupling portion pieces.

In addition, since the notch portion 62 is formed on the inner surface side of the coupling portion 61, an external force applied to the notch portion 62 to thereby expand the cap portions 51*a* and 51*b* outward acts efficiently on a thin portion of the notch portion 62. Thus, the coupling portion 61 can be cracked easily.

From the nature of polypropylene, when it is too thin, it bends due to its viscosity in accordance with an external force applied thereto. It is therefore difficult to crack polypropylene. However, polypropylene can be cracked easily when it has a predetermined thickness, for example, a thickness approximately in a range of from 1.5 mm to 2.5 mm.

In this case, it is preferable that the depth of the notch portion is also approximately in a range of from 1.5 mm to 2.5 mm. In this embodiment, the thickness of the coupling portion 61 as a whole is set to be in a range of from 3 mm to 5 mm, and the depth of the notch portion 62 is set to be in a range of from 1.5 mm to 2.5 mm. That is, it is preferable that the notch portion 62 having a depth about half as large as the thickness of the coupling portion 61 is provided.

After predetermined tests for the image forming operation, the image quality and so on in a factory are terminated as the ink cartridges 16 are mounted, the inkjet recording apparatus mounted with the ink supply port sealing cap 51 in place of the ink cartridges 16 is shipped. For example, when the inkjet recording apparatus is used by a user as a facsimile machine exclusively for recording in black ink, the user or a serviceman removes the ink supply port sealing cap 51, and then applies a force to the coupling portion 61, particularly to the notch portion 62, so as to crack and divide the coupling portion 61 into the first and second cap portions 51*a* and 51*b*. After that, for example, a black ink cartridge is attached in place of the first cap portion 51*a*, while the separated second cap portion 51*b* is attached again. Thus, an image can be formed using only black ink. On the contrary, when the user wants to perform color printing using only color inks, color ink cartridges are attached in place of the second cap portion 51*b*, and the first cap portion 51*a* is attached to the portion where the black ink cartridge should be attached. Thus, color printing can be supported.

In such a manner, the coupling portion 61 which can divide the ink supply port sealing cap 51 into the first and second cap portions 51*a* and 51*b* is provided in the ink supply port sealing cap 51. Accordingly, when a user wants to record using only black ink, the second cap portion 51*b* is used. Thus, the user or the like does not have to purchase not-to-be-used color ink cartridges especially and attach them. It is therefore possible to properly meet a demand of the user or the like to use only the black ink. On the other hand, a user or the like wanting to use only color inks uses the first cap portion 51*a*. Thus, the user or the like does not have to purchase a not-to-be-used black ink cartridge especially and attach it. Also in this case, it is possible to properly meet a demand of the user or the like.

In a monochrome recording mode in which a user performs monochrome recording using a real black ink cartridge and the second cap portion 51*b*, nozzles for ejecting black ink become targets of a purging operation or a flushing operation. In the purging operation, the nozzle portion of the black ink is covered with the suction cap 28*a*, and defective ink in the recording head unit 15 is sucked due to negative pressure generated by a suction pump. Thus, the recording head unit 15 is recovered from failure in recording. In the flushing operation, ink is forcibly ejected from the nozzle portion of the recording head unit 15 so as to free the nozzle portion from ink clogging. On the other hand, the nozzle portions of color inks to which the second cap portion 51*b* is attached do not need purging or flushing. Thus, either operation is not performed on the nozzle portions of the color inks.

On the contrary, in a color recording mode in which a user performs color recording using real color ink cartridges and the first cap portion 51*a*, nozzles for ejecting color inks become targets of a purging operation or a flushing operation. In the same manner as mentioned above, in the purging operation, the nozzle portions of the color inks are covered with the suction caps 28*a*, and defective ink in the recording head unit 15 is sucked due to negative pressure generated by a suction pump. Thus, the recording head unit 15 is recovered from failure in recording. In the flushing operation, inks are forcibly ejected from the nozzle portions of the recording head unit 15 so as to free the nozzle portions from ink clogging. On the other hand, the nozzle portion of the black ink to which the first cap portion 51*a* is attached does not need purging or flushing. Thus, either operation is not performed on the nozzle portion of the black ink.

In this embodiment, the coupling portion 61 is provided on the ink supply port 41 side of the recording head unit 15 when the ink supply port sealing cap 51 is attached to the recording head unit 15. Thus, the sealing portions 53 of the ink supply port sealing cap 51 can be positioned with respect to the ink supply ports 41 and attached thereto accurately. It is therefore possible to surely prevent a preservative solution from leaking out and surely prevent the preservative solution from being evaporated.

In addition, the protrusions 59 retains a predetermined distance between each sealing portion 53 of each cap portion 51*a*, 51*b* and the elastic ring 42 (seal member) for sealing each ink supply port 41 of the recording head unit 15. Thus, there is no fear that the elastic ring 42 is deformed to lose the sealing effect. In addition, the protrusions 59 are formed in one or both of the lower surfaces of the cap portions 51*a* and 51*b*. Thus, when the cap portions 51*a* and 51*b* are separated for use, each protrusion 59 retains the elastic ring 42 without crushing it. Thus, there is no fear that the elastic ring 42 is deformed to lose the sealing effect.

Figure 8:
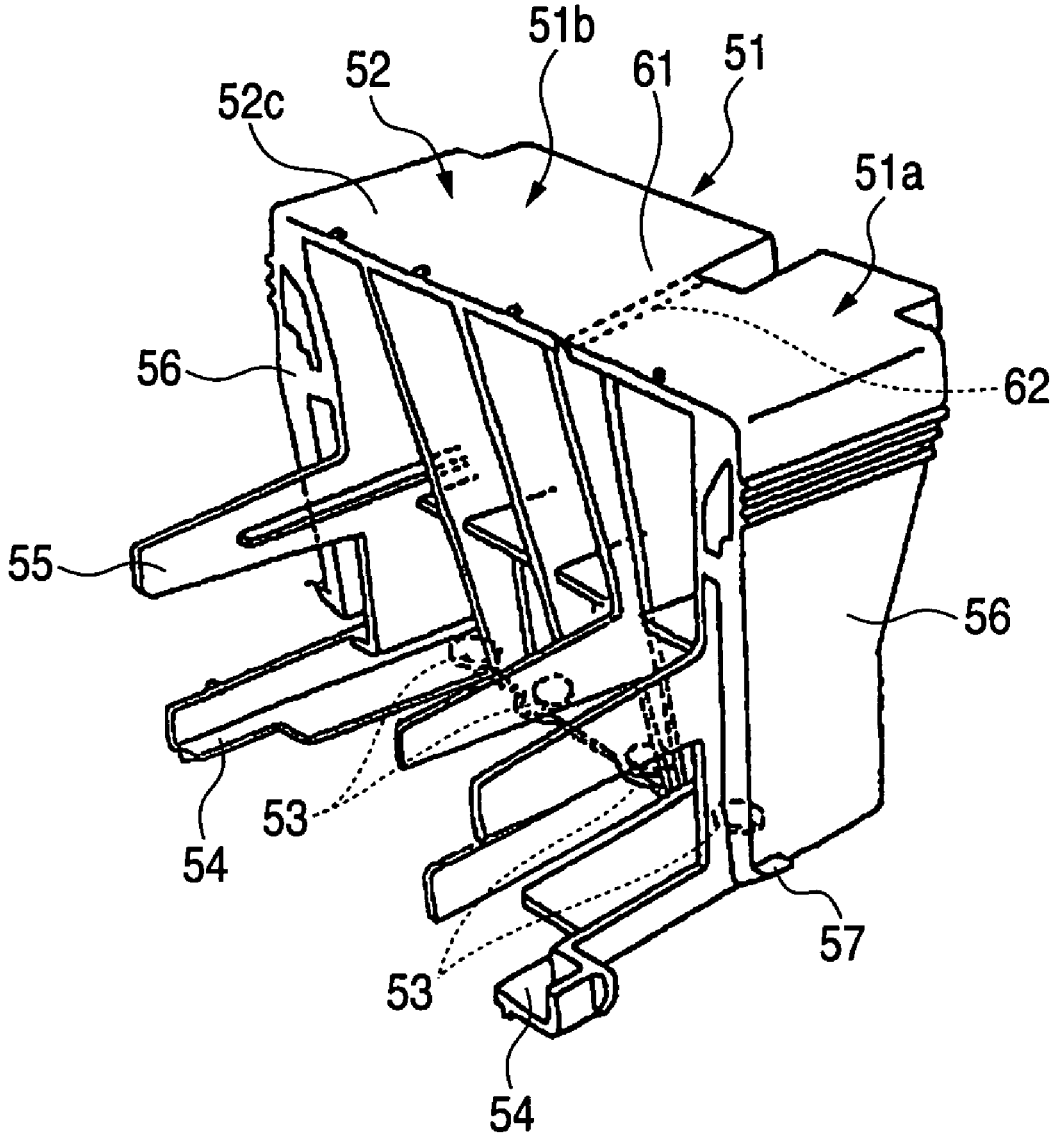
FIG. 8 is a perspective view of a modification of an ink supply port sealing cap.

FIG. 8 shows an example in which the coupling portion 61 is formed, for example, on the opposite side of the ink supply port sealing cap 51 to the sealing portions 53, for example, on the top of the ink supply port sealing cap 51.

The ink supply port sealing cap 51 includes the cap portions 51*a* and 51*b*, and the coupling portion 61 for coupling the cap portions 51*a* and 51*b* with each other is disposed on the side (the top in FIG. 8) of the ink supply port sealing cap 51 opposite to the sealing portions 53. The coupling portion 61 has the notch portion 62 formed on its inner surface side. The coupling portion 61 can be cracked by an external force applied to the notch portion 62. In this case, in the same manner as described above, the notch portion 62 is formed in the coupling portion 61 at a predetermined angle, for example, an angle of 45 degrees. An external force acts on the notch portion 62 effectively so that the coupling portion 61 can be cracked easily.

In this event, since the notch portion 62 is formed near the second cap portion 51*b* and cut toward the first cap portion 51*a* at an angle of 45 degrees as described above, the coupling portion 61 is cracked due to an external force applied thereto so that most of coupling portion pieces survive on the first cap portion 51*a* side as shown in FIG. 5D. Accordingly, when black printing is performed in the state where a black ink cartridge is attached in place of the first cap portion 51*a* and the second cap portion 51*b* is mounted in the portion where the color ink cartridges should be mounted, there is no fear that the coupling portion pieces generated when the coupling portion 61 is cracked project from the second cap portion 51*b*. Thus, the black ink cartridge can be mounted without being disturbed by the coupling portion pieces.

Since it is decided in this embodiment that the number of users wanting to record using only black ink is larger, the notch portion 62 is formed so that the coupling portion pieces survive on the first cap portion 51*a* side. However, for a user wanting to record using only color inks, the notch portion 62 maybe formed so that the coupling portion pieces can survive on the second cap portion 51*b* side. Alternatively, the notch portion 62 may be formed in an inverted-V shape substantially at the center of the coupling portion 61 so as to allow the coupling portion pieces to survive uniformly on the first cap portion 51*a* side and on the second cap portion 51*b* side. Thus, either the cap portion 51*a* or the cap portion 51*b* can be used after the ink supply port sealing cap 51 is cracked.

Further, the coupling portions 61 may be provided both on the ink supply port 41 side of the recording head unit 15 and on the side (on the top plate 52*c* side) of the ink supply port sealing cap 51 opposite to the sealing portions 53. With such a configuration, it is possible to provide a firmly stable ink supply sealing cap 51.

Next, description will be made on modifications of the coupling portion 61 of the ink supply port sealing cap 51.

Figure 9A:
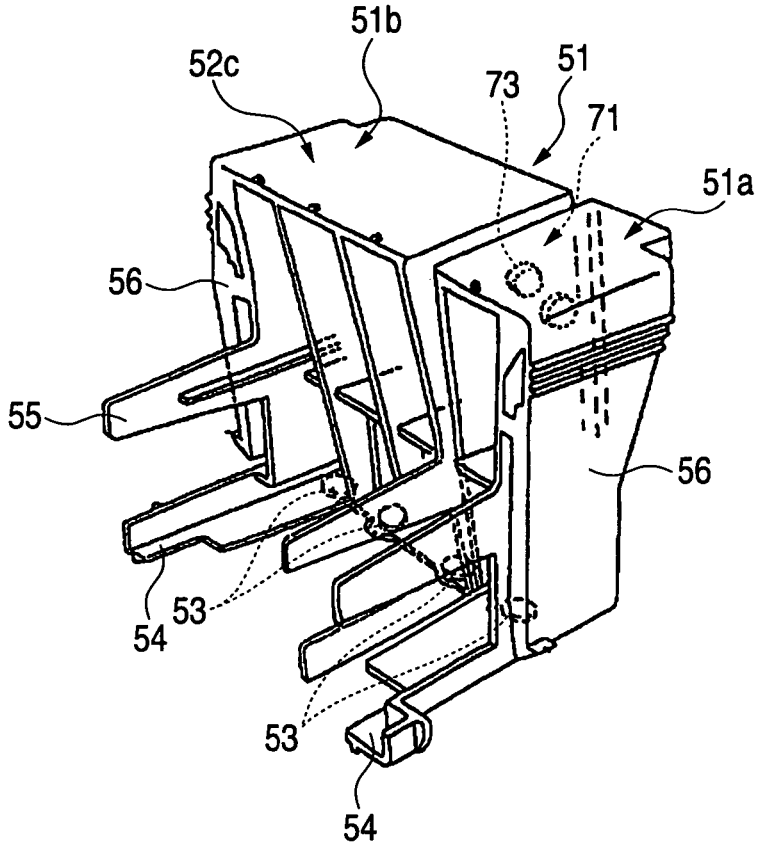
FIG. 9A is a perspective view of a modification of a coupling portion.
Figure 9B:
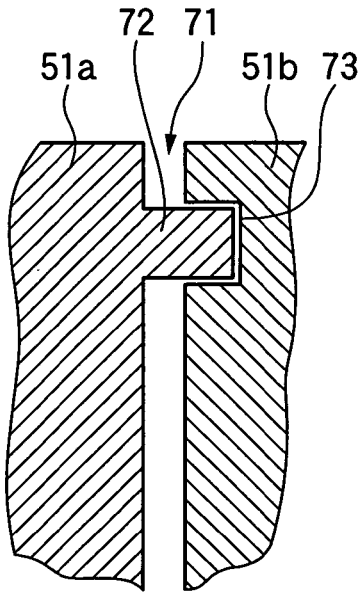
FIG. 9B is a partially enlarged view of the coupling portion.

In FIGS. 9A and 9B, a protrusion portion 72 is formed in the first cap portion 51*a* of the ink supply port sealing cap 51, and a recess portion 73 is formed in the second cap portion 51*b*. In FIG. 9B, the protrusion portion 72 is depicted as smaller than the recess portion 73 in order to make it easy to distinguish the protrusion portion 72 and the recess portion 73 from each other. Actually, the protrusion portion 72 is formed to be a little larger than the recess portion 73. Accordingly, when the protrusion portion 72 is pressed toward the recess portion 73, the protrusion portion 72 slides on the inner wall surface of the recess portion 73 and is received in the recess portion 73 so that the both are coupled firmly. Thus, a fitting portion 71 separably coupling the first cap portion 51*a* and the second cap portion 51*b* with each other is formed. When the protrusion portion 72 and the recess portion 73 are fitted to each other, the first cap portion 51*a* and the second cap portion 51*b* can be coupled. When the protrusion portion 72 and the recess portion 73 fitted to each other are separated, the cap portions 51*a* and 51*b* can be separated. Further, when the protrusion portion 72 is fitted into the recess portion 73 again, the first cap portion 51*a* and the second cap portion 51*b* can be coupled again. Thus, the cap portions 51*a* and 51*b* can be separated and coupled repeatedly.

In such a manner, the cap portions 51*a* and 51*b* can be separated and coupled repeatedly through the protrusion portion 72 and the recess portion 73 formed integrally with the cap portions 51*a* and 51*b* respectively and fitted to each other. Accordingly, even after the cap portions 51*a* and 51*b* separated from each other and attached to mounting portions are used, they can be coupled again. Thus, it becomes easy to handle or store the cap portions 51*a* and 51*b*.

Figure 9C:
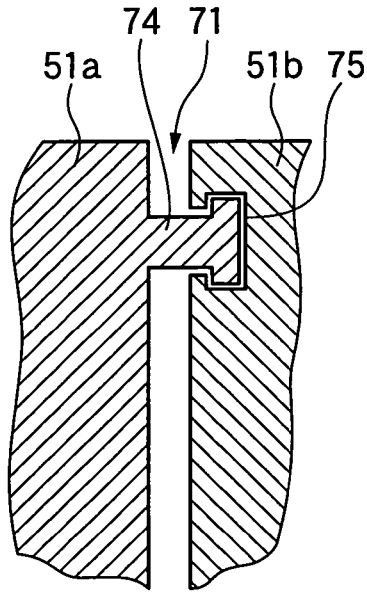
FIG. 9C shows another modification of a coupling portion.

The protrusion portion 72 and the recess portion 73 have been described as a fitting type in FIGS. 9A and 9B. Not to say, in place of the protrusion portion 72 and the recess portion 73, for example, a protrusion extending longitudinally may be formed in the front end of a protrusion portion 74, and made to slide on a sliding hole provided in a recess portion 75, so as to be engaged with the inner wall surface of the recess portion 75, as shown in FIG. 9C. In FIG. 9C, the protrusion portion 74 is depicted as smaller than the recess portion 75 in order to make it easy to distinguish the protrusion portion 74 and the recess portion 75 from each other. Actually, the protrusion portion 74 is formed to be a little larger than the recess portion 75.

Also in these modifications, the protrusion portion 72, 74 is formed in the first cap portion 51*a*, and the recess portion 73, 75 is formed in the second cap portion 51*b*. As described previously, however, the layout relationship between the protrusion portion and the recess portion may be reversed. That is, the protrusion portion 72, 74 may be formed in the second cap portion 51*b* while the recess portion 73, 75 is formed in the first cap portion 51*a*.

Figure 10A:
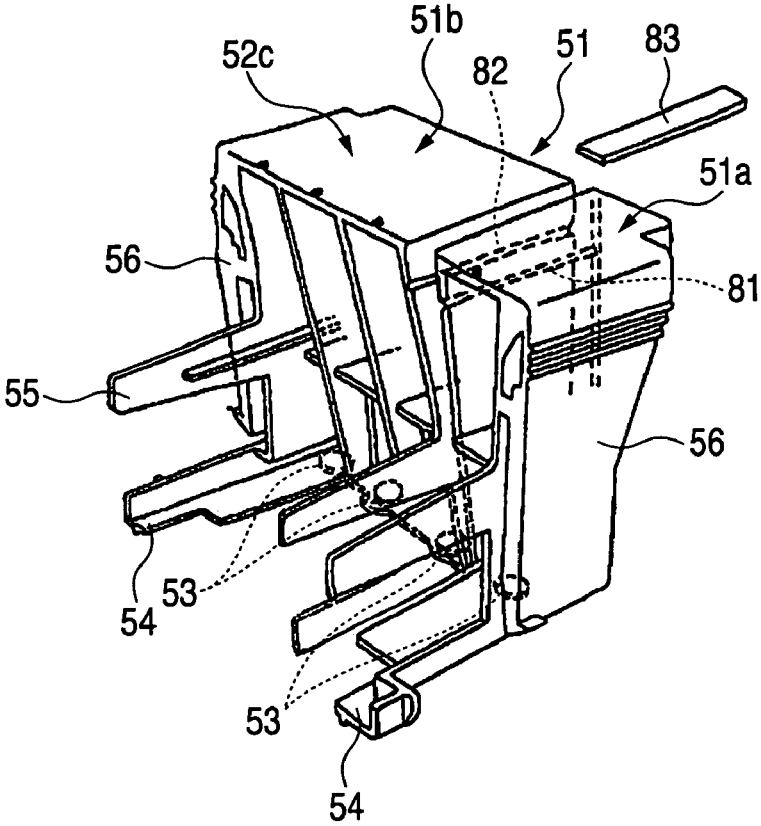
FIG. 10A is a perspective view of a modification of a coupling portion.
Figure 10B:
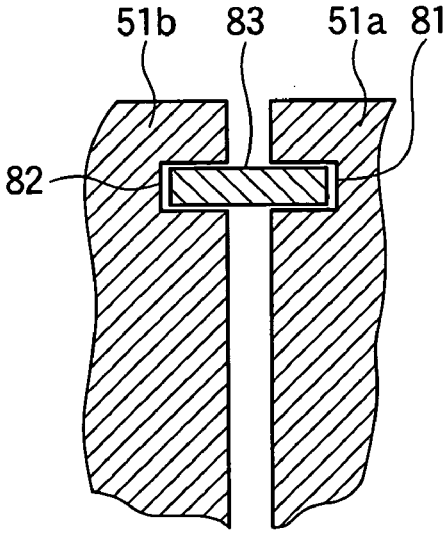
FIG. 10B is a partially enlarged view of the coupling portion.
Figure 10C:
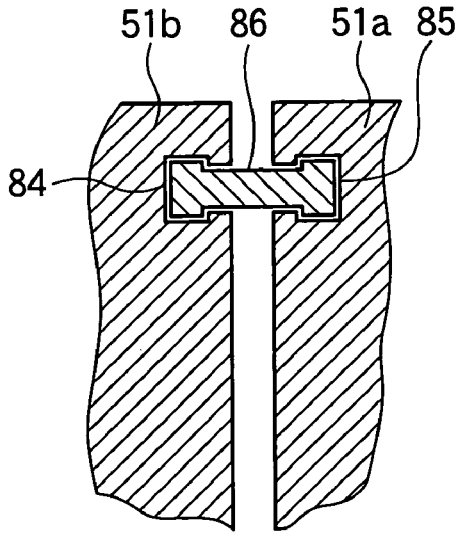
FIG. 10C shows another modification of a coupling portion.

FIGS. 10A to 10C show other modifications of the coupling portion. In FIGS. 10A to 10C, the reference numeral 81 represents a groove formed in the first cap portion 51*a*; and 82, a groove formed in the second cap portion 51*b*. Incidentally, the grooves 81 and 82 are formed to have an equal width in the longitudinal direction (up/down direction in FIGS. 10A to 10C). In FIG. 10B, a coupling plate 83 is depicted as smaller than each groove 81, 82 in order to make it easy to distinguish the coupling plate 83 and the groove 81, 82 from each other. Actually, the coupling plate 83 is formed to be a little larger than the groove 81, 82. When the coupling plate 83 is made to slide toward the grooves 81 and 82, the coupling plate 83 slides on the inner wall surfaces of the grooves 81 and 82 and is received in the grooves 81 and 82. Thus, the coupling plate 83 is firmly coupled with the grooves 81 and 82 so that the first and second cap portions 51*a* and 51*b* are separably coupled with each other.

Also with such a configuration, the cap portions 51*a* and 51*b* are formed separately from each other, so that they can be coupled again by a fitting portion which can be fitted to the cap portions 51*a* and 51*b*. Thus, the ink supply port sealing cap 51 can be used repeatedly and handled easily. In addition, since the fitting portion is separate from each cap portion, there is no portion projecting from the cap portion. Thus, it is easy to store the ink supply port sealing cap 51.

FIGS. 10A and 10B show the configuration in which the coupling plate 83 is fitted to the grooves 81 and 82. Not to say, in place of the configuration, a protrusion may be formed in each of opposite end portions of a coupling plate 86 while a recess portion having a shape corresponding to the shape of the end portion of the coupling plate 86 is formed in an inner deep surface of each of the grooves 84 and 85 so that the end portions of the coupling plate 86 are engaged with the recess portions, as shown in FIG. 10C. In FIG. 10C, the coupling plate 86 is depicted as smaller than each groove 84, 85 in order to make it easy to distinguish the coupling plate 86 and the groove 84, 85 from each other. Actually, the coupling plate 86 is formed to be a little larger than the groove 84, 85.

Incidentally, the invention is not limited to the aforementioned modification. The invention can be applied to various forms without departing from the features of the invention.

In the embodiment, the above-described recording operation in which performed to form an image on the sheet P, is controlled by the control unit 9. The recording operation includes: controlling and driving (moving) the carriage 10 forward and backward in parallel with the guide shaft 11; discharging ink from the nozzle portion 15*a* onto the sheet P; the purging operation; and the flushing operation.

The control unit 9 performs the recording operation in a condition where either one of the black ink cartridge and the color ink cartridge is mounted on the mounting portion 4 and either one of the first cap portion 51*a* and the second cap portion 51*b* is mounted on the mounting portion 4 in place of the other of the black ink cartridge and the color ink cartridge.

In the embodiment, the ink supply port sealing cap 51 is configured to have two cap portions 51*a*, 51*b*. However, the ink supply port sealing cap 51 may be configured to have a plurality of cap portions that are more than two. For example, the ink supply port sealing cap 51 may be configured to have four cap portions each of which corresponds to each of the four ink cartridges (black, yellow, magenta, and cyan), and adjacent cap portions being coupled by the coupling portions.

As described above, according to a first configuration of the invention, there is provided an ink supply port sealing cap to be used in an inkjet recording apparatus including a recording head unit having nozzles for ejecting ink, and first and second ink supply ports for supplying ink from first and second ink cartridges to the nozzles respectively, the ink supply port sealing cap including: a first cap portion that seals the fist ink supply port; a second cap portion that seals the second ink supply port; and a coupling portion that separably couples the first and second cap portions.

According to the first configuration, the first cap portion and the second cap portion are separably coupled through the coupling portion so that the first and second cap portions can be mounted in one work on a manufacturing line. Thus, the working efficiency can be improved. Further, a user wanting to record using only the ink in the first ink cartridge can record using only the ink in the first ink cartridge as long as the ink from the first ink cartridge is supplied to the first ink supply port while the second ink supply port is sealed by the second cap portion. Thus, recording can be performed without purchasing and mounting a real second ink cartridge. On the contrary, a user wanting to record using only the ink in the second ink cartridge can record using only the ink in the second ink cartridge as long as the ink from the second ink cartridge is supplied to the second ink supply port while the first ink supply port is sealed by the first cap portion. Thus, recording can be performed without purchasing and mounting a real first ink cartridge.

According to a second configuration of the invention, in the ink supply port sealing cap having the first configuration, the inkjet recording apparatus includes a mounting portion for mounting the first and second ink cartridges, and wherein the ink supply port sealing cap is to be mounted on the mounting portion in place of at least one of the fist and second ink cartridges.

According to a third configuration of the invention, in the ink supply port sealing cap having the first configuration, the mounting portion includes first and second mounting portions for mounting the first and second ink cartridges respectively, and wherein the first cap portion is to be mounted on the first mounting portion and the second cap portion is to be mounted on the second mounting portion.

According to a fourth configuration of the invention, in the ink supply port sealing cap having the first configuration, the coupling portion is arranged to be able to couple the first and second cap portions with each other again after separating the first and second cap portions from each other.

According to the fourth configuration, the first and second cap portions can be assembled through the coupling portion again after being separated and mounted. Thus, the ink supply port sealing cap can be used repeatedly and handled easily.

According to a fifth configuration of the invention, in the ink supply port sealing cap having the fourth configuration, the coupling portion includes a pair of fitting portions formed integrally with the first and second cap portions respectively so as to be fitted to each other.

According to the fifth configuration, the coupling portion is formed integrally with each of the cap portions. Thus, in addition to the same advantage as that in the fourth configuration, there can be obtained an effect that the coupling portion can be formed easily together with the ink supply port sealing cap.

According to a sixth configuration of the invention, in the ink supply port sealing cap having the fourth configuration, the coupling portion is formed separately from each of the first and second cap portions, and includes a fitting portion which is to be fitted to each of the first and second cap portions.

According to the sixth configuration, the coupling portion is formed out of the fitting portion separate from each cap portion. Thus, in addition to the same advantage as that in the fourth configuration, there can be obtained an effect that there is no portion projecting from the cap portion, and it becomes easy to mount the ink supply port sealing cap.

According to a seventh configuration of the invention, in the ink supply port sealing cap having the first configuration, the coupling portion is formed to separate the first and second cap portions from each other when being cracked.

According to the seventh configuration, the same advantage as that in the first configuration can be obtained.

According to an eighth configuration of the invention, in the ink supply port sealing cap having the seventh configuration, the coupling portion includes a notch portion that separates the first and second cap portions from each other when being cracked along the notch portion.

According to the eighth configuration, the notch portion of the coupling portion is formed to be thinner than any other portion. Thus, when an external force is applied to the notch portion, the coupling portion can be cracked easily so that the cap portions can be separated from each other easily.

According to a ninth configuration of the invention, in the ink supply port sealing cap having the eighth configuration, the notch portion is formed on an inner surface of the coupling portion.

According to the ninth configuration, when an external force is applied to the notch portion of the coupling portion so as to spread the cap portions outward and separate the cap portions from each other, the external force acts on the notch portion effectively. Thus, the coupling portion can be cracked easily.

According to a tenth configuration of the invention, in the ink supply port sealing cap having the seventh configuration, the coupling portion is formed in a thickness to be easily cracked by an external force applied to separate the first and second cap portions.

According to the tenth configuration, since the coupling portion is formed to be thin enough to be cracked easily, the coupling portion can be cracked by a small force when the force is externally applied to the coupling portion so as to separate the cap portions from each other.

According to an eleventh configuration of the invention, in the ink supply port sealing cap having the first configuration, the first and second cap portions include sealing portions that seals that is formed to protrude from a surface of the first and second cap portions and seals the first and second ink supply port.

According to a twelfth configuration of the invention, in the ink supply port sealing cap having the eleventh configuration, at least one of the first and second cap portions includes a regulation member that regulates a distance between the first and second ink supply ports of the inkjet recording apparatus and the sealing portions.

According to the twelfth configuration, the seal members provided in the ink supply ports are not excessively pressed. Thus, any deformation of the seal members, which results in reducing the sealing effect, can be avoided, so that ink leakage from the ink supply ports can be prevented surely.

According to a thirteenth configuration of the invention, in the ink supply port sealing cap having the twelfth configuration, the regulation member is disposed at a lower surface of both of the first and second cap portions.

According to the thirteenth configuration, the regulation member is provided on each of the first lower surface of the first cap portion and the second lower surface of the second cap portion. Thus, even when each cap portion is used separately, each cap portion provided with the regulation member can be used independently, and there is no fear that the cap portion in use excessively presses the seal member provided in the ink supply port. Thus, any deformation of the seal members, which results in reducing the sealing effect, can be avoided, so that ink leakage from the ink supply port can be prevented surely.

According to a fourteenth configuration of the invention, in the ink supply port sealing cap having the eleventh configuration, the coupling portion is disposed at least at a side where the sealing portions are formed.

According to the fourteenth configuration, since the coupling portion is disposed on the sealing portion side of the ink supply ports in the ink supply port sealing cap, accurate positioning can be performed between each sealing portion of the ink supply port sealing cap and each ink supply port so that the ink supply port can be sealed surely. It is therefore possible to surely prevent a preservative solution etc. from leaking out and surely prevent the ink from being evaporated.

According to a fifteenth configuration of the invention, in the ink supply port sealing cap having the eleventh configuration, the coupling portion is disposed on a side opposite to a side where the sealing portions are formed.

According to the fifteenth configuration, since the coupling portion is disposed on the opposite side to the sealing portion side of the ink supply port sealing cap, the coupling portion can be formed without being disturbed by any other member of the ink supply port sealing cap such as the sealing portions when the coupling portion is formed. Thus, the work of forming the coupling portion can be performed easily.

According to a sixteenth configuration of the invention, in the ink supply port sealing cap having the eleventh configuration, the sealing portions are formed of polypropylene.

According to a seventeenth configuration of the invention, in the ink supply port sealing cap having the first configuration, the ink supply port sealing cap is formed of polypropylene.

Polypropylene has a characteristic that it bends large enough not to be cracked due to its viscosity when it is thin, while it is cracked easily when it has a predetermined thickness. The ink supply port sealing caps having the sixteenth and the seventeenth configurations are formed with an enough thickness to be cracked easily by an external force applied thereto. Thus, the ink supply port sealing cap can be cracked easily so that the cap portions can be separated from each other easily.

According to an eighteenth configuration of the invention, in the ink supply port sealing cap having the first configuration, the first and second cap portions are formed in a shape to be fixed to the inkjet recording apparatus in a mounting portion by a fixing device, the mounting portion for mounting the first and second ink cartridges, and the fixing device for fixing the first and second ink cartridges.

According to a nineteenth configuration of the invention, there is provided an inkjet recording apparatus including: a recording head unit having nozzles for ejecting ink; a mounting portion on which first and second ink cartridges are mounted, and on which first and second cap portions of an ink supply port sealing cap are to be mounted in place of the first and second ink cartridges respectively, the ink supply port sealing cap including a coupling portion that separably couples the first and second cap portions; first and second ink supply ports that supply ink from the first and second ink cartridges to the nozzles respectively, the first and second ink supply ports are sealed by the first and second cap portions respectively; and a control unit that controls the recording head unit to perform a recording operation, and performs the recording operation in a condition where either one of the first and second ink cartridges is mounted on the mounting portion and either one of the first and second cap portions is mounted on the mounting portion in place of the other of the first and second ink cartridges.

The inkjet recording apparatus according to the nineteenth configuration is used in the condition that the first cap portion or the second cap portion according to any one of the first to thirteenth configurations is mounted. Accordingly, for a user wanting to record using only the ink in the first ink cartridge, recording using only the ink in the first ink cartridge can be performed when the ink is supplied from the first ink cartridge to the first ink supply port while the second ink supply port is sealed by the second cap portion. Thus, recording can be performed without purchasing and mounting a real second ink cartridge. On the contrary, for a user wanting to record using only the ink in the second ink cartridge, recording using only the ink in the second ink cartridge can be performed when the ink is supplied from the second ink cartridge to the second ink supply port while the first ink supply port is sealed by the first cap portion. Thus, recording can be performed without purchasing and mounting a real first ink cartridge.

According to a twentieth configuration of the invention, the inkjet recording apparatus having the nineteenth configuration includes: a fixing device that fixes the first and second ink cartridges onto the mounting portion, and fixes the first and second cap portions onto the mounting portion when the first and second cap portions being mounted on the mounting portion in place of the first and second ink cartridges.

According to the inkjet recording apparatus having the twentieth configuration, in addition to the advantage in the nineteenth configuration, the first or second cap portion can seal the ink supply port surely because the first or second cap portion is fixed to the mounting portion by the fixing device for fixing the first and second ink cartridges.

According to a twenty-first configuration of the invention, the inkjet recording apparatus having the nineteenth configuration is shipped in a condition where both of the first and second cap portions of the ink supply port sealing cap is fixed to the mounting portion by the fixing device.

According to the inkjet recording apparatus according to the twenty-first configuration, the inkjet recording apparatus is shipped in the condition that the ink supply port sealing cap comprised of the first and second cap portions is fixed to the mounting portion by the fixing device. Thus, the ink or a preservative solution charged into the ink cartridges can be surely prevented from leaking out due to the upside-down posture of the inkjet recording apparatus during transportation or storage.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink supply port sealing cap to be used in an inkjet recording apparatus including a recording head unit having nozzles for ejecting ink, and first and second ink supply ports for supplying ink from first and second ink cartridges to the nozzles respectively, the ink supply port sealing cap comprising:

a first cap portion that seals the fist ink supply port;

a second cap portion that seals the second ink supply port; and a coupling portion that separably couples the first and second cap portions.

2. The ink supply port sealing cap according to claim 1, wherein the inkjet recording apparatus includes a mounting portion for mounting the first and second ink cartridges, and wherein the ink supply port sealing cap is to be mounted on the mounting portion in place of at least one of the fist and second ink cartridges.

3. The ink supply port sealing cap according to claim 2, wherein the mounting portion includes first and second mounting portions for mounting the first and second ink cartridges respectively, and wherein the first cap portion is to be mounted on the first mounting portion and the second cap portion is to be mounted on the second mounting portion.

4. The ink supply port sealing cap according to claim 1, wherein the coupling portion is arranged to be able to couple the first and second cap portions with each other again after separating the first and second cap portions from each other.

5. The ink supply port sealing cap according to claim 4, wherein the coupling portion includes a pair of fitting portions formed integrally with the first and second cap portions respectively so as to be fitted to each other.

6. The ink supply port sealing cap according to claim 4, wherein the coupling portion is formed separately from each of the first and second cap portions, and includes a fitting portion which is to be fitted to each of the first and second cap portions.

7. The ink supply port sealing cap according to claim 1, wherein the coupling portion is formed to separate the first and second cap portions from each other when being cracked.

8. The ink supply port sealing cap according to claim 7, wherein the coupling portion includes a notch portion that separates the first and second cap portions from each other when being cracked along the notch portion.

9. The ink supply port sealing cap according to claim 8, wherein the notch portion is formed on an inner surface of the coupling portion.

10. The ink supply port sealing cap according to claim 7, wherein the coupling portion is formed in a thickness to be easily cracked by an external force applied to separate the first and second cap portions.

11. The ink supply port sealing cap according to claim 1, wherein the first and second cap portions include sealing portions that is formed to protrude from a surface of the first and second cap portions and seals the first and second ink supply port.

12. The ink supply port sealing cap according to claim 11, wherein at least one of the first and second cap portions includes a regulation member that regulates a distance between the first and second ink supply ports of the inkjet recording apparatus and the sealing portions.

13. The ink supply port sealing cap according to claim 12, wherein the regulation member is disposed at a lower surface of both of the first and second cap portions.

14. The ink supply port sealing cap according to claim 11, wherein the coupling portion is disposed at least at a side where the sealing portions are formed.

15. The ink supply port sealing cap according to claim 11, wherein the coupling portion is disposed on a side opposite to a side where the sealing portions are formed.

16. The ink supply port sealing cap according to claim 11, wherein the sealing portions are formed of polypropylene.

17. The ink supply port sealing cap according to claim 1, wherein the ink supply port sealing cap is formed of polypropylene.

18. The ink supply port sealing cap according to claim 1, wherein the first and second cap portions are formed in a shape to be fixed to the inkjet recording apparatus in a mounting portion by a fixing device, the mounting portion for mounting the first and second ink cartridges, and the fixing device for fixing the first and second ink cartridges.

19. An inkjet recording apparatus comprising:

a recording head unit having nozzles for ejecting ink;

a mounting portion on which first and second ink cartridges are mounted, and on which first and second cap portions of an ink supply port sealing cap are to be mounted in place of the first and second ink cartridges respectively, the ink supply port sealing cap including a coupling portion that separably couples the first and second cap portions;

first and second ink supply ports that supply ink from the first and second ink cartridges to the nozzles respectively, the first and second ink supply ports are sealed by the first and second cap portions respectively; and a control unit that controls the recording head unit to perform a recording operation, and performs the recording operation in a condition where either one of the first and second ink cartridges is mounted on the mounting portion and either one of the first and second cap portions is mounted on the mounting portion in place of the other of the first and second ink cartridges.

20. The inkjet recording apparatus according to claim 19 further comprising a fixing device that fixes the first and second ink cartridges onto the mounting portion, and fixes the first and second cap portions onto the mounting portion when the first and second cap portions being mounted on the mounting portion in place of the first and second ink cartridges.

21. The inkjet recording apparatus according to claim 20, wherein the inkjet recording apparatus is shipped in a condition where both of the first and second cap portions of the ink supply port sealing cap is fixed to the mounting portion by the fixing device.

* * * * *